United States Patent [19]

Debenham et al.

[11] Patent Number: 4,677,757

[45] Date of Patent: Jul. 7, 1987

[54] OVEN

[75] Inventors: Michael Debenham, Frankston; James D. Farfor, Cannons Creek, both of Australia

[73] Assignee: The Broken Hill Proprietary Company Limited, Melbourne, Australia

[21] Appl. No.: 614,648

[22] Filed: May 29, 1984

[30] Foreign Application Priority Data

Jun. 2, 1983 [AU] Australia ..... PF9664

[51] Int. Cl.[4] ..... F26B 3/28; B05D 7/22

[52] U.S. Cl. ..... 34/4; 427/236; 432/230; 432/128

[58] Field of Search ..... 432/128, 230, 231; 34/4; 219/388; 427/236

[56] References Cited

U.S. PATENT DOCUMENTS

| | | | |
|---|---|---|---|
| 784,856 | 3/1905 | Green | 432/230 |
| 2,846,972 | 8/1958 | Bofinger . | |
| 3,837,794 | 9/1974 | Phillips | 432/128 |
| 3,995,075 | 11/1976 | Cernauskas et al. | 427/236 |
| 4,311,458 | 1/1982 | Caratach | 432/121 |
| 4,327,665 | 5/1982 | Arrasmith | 34/4 |
| 4,434,562 | 3/1984 | Bubley et al. | 34/4 |

FOREIGN PATENT DOCUMENTS

| | | | |
|---|---|---|---|
| 2517041 | 5/1983 | France . | |
| 456966 | 2/1975 | U.S.S.R. | 34/4 |

*Primary Examiner*—Henry C. Yuen

*Attorney, Agent, or Firm*—Murray and Whisenhunt

[57] ABSTRACT

An oven for heating can ends comprising a generally elongate heating chamber having walls which closely surround a conveyor for conveying the can ends through the chamber, a source of infra-red heat arranged in the upper region of said chamber and having a parabolic reflector by means of which radiant heat is directed downwardly onto a generally narrow band which corresponds in width to the width of the region of the can end to which sealant and/or repair lacquer has been applied, said conveyor being constructed from a plurality of interconnected slat-like elements having upturned edges the spacing between the upturned edges being selected so that the edges engage narrow portions of the curled edge of the can end whereby the can end is supported with the surface to which sealant or lining compound has been applied direction downwardly so that the heat source principally heats the upwardly directed surface of the can ends, a cooling chamber of similar dimensions to said heating chamber following said heating chamber, said cooling chamber including a cooling air outlet which directs a stream of cool air onto a central region of each can end as it is conveyed through said cooling region.

3 Claims, 2 Drawing Figures

OVEN

BACKGROUND OF THE INVENTION

This invention relates to improvements in ovens and transporting systems for ovens for the curing of sealants and baking of lacquers applied to ends for containers such as cans.

Easy-opening can ends of the push-in type, such as those described in Australian Pat. Nos. 444,068, 518,940, 523,783, 528,006 and Application No. 61388/80 require discrete areas of sealant to be applied in the region of the edges of the push-in tabs to hermetically seal the can end. Sealant is usually applied to discrete areas covering the cut edges of the tabs and openings, for example by the system described in Australian Pat. No. 477,562.

In the case of so-called "ring-pull ends", it is sometimes necessary to apply repair lacquer to the can end in the region of the score defining the tab and this lacquer is usually subsequently baked to drive off volatiles.

Where easy-opening can ends of the push-in type are manufactured from steel, it is desirable to protect the shorn edges of the opening(s) formed by the end conversion process and this may be done by spraying repair lacquer or some other form of repair coating onto the can end in that region of the end. This protective material must similarly be baked to drive off volatiles and to ensure that the lacquer is substantially dry before the can ends are stored or packaged for future use.

Until the present invention, ovens used in the can manufacturing industry have been extremely large, inefficient and not particularly suited to the efficient curing of sealant applied to push-in tab ends or to the efficient baking of repair lacquer applied to such ends. Known ovens not only occupy much valuable floor space in a can manufacturing plant but also cause the surrounding areas of the plant to be undesirably heated making it uncomfortable for the plant operators.

SUMMARY OF THE INVENTION

It is the object of the present invention to provide several distinct and desirable improvements to ovens suitable for heating can ends for the above described and other purposes.

In a first aspect, the present invention provides an oven for heating can ends comprising a generally elongate heating chamber, a source of heat operable to heat said chamber, conveying means for supporting said can ends as they are conveyed through said heating chamber, said conveying means being constructed to support said can ends with the surface to which sealant or lining compound has been applied directed downwardly and with said heat source operable principally to heat the upwardly directed surface of said can ends.

By conveying the can ends through the heating chamber in the above manner, heat is applied principally to the upper surface of the end and the metal is heated to ensure that the sealant applied to the opposite surface is heated by a conduction process through the metal and then outwardly through the sealant rather than from the outside surface of the sealant inwardly. Thus, the non-critical outside surface of the end is heated and the likelihood of a cured skin forming over the surface of any repair lacquer on the end is reduced whereby the proper curing of the sealant and the proper escape of volatiles is enhanced.

Furthermore, since the sealant is directed downwardly, it tends to retain its discrete 'printed' shape and profile and has less tendency to spread as it is heated.

The heat source is preferably a radiant heat source located within the elongate heating chamber and incorporating means for directing radiant heat onto the upwardly directed surface of the can ends as they pass through the heating chamber. More preferably, the heat source is an infra-red heat source having a high density short-wave length emanation which is selected to penetrate any repair lacquer applied to the upwardly directed surface of the can end so as to directly heat the metal of the end. The wave length of the emanation is preferably of the order of 1 micron and the temperature of the heat source is preferably of the order of 2120°C.

In a second aspect of the invention, there is provided an oven for heating can ends comprising a generally elongate heating chamber, means for applying heat to the chamber, conveying means for supporting said can ends as they are conveyed through said heating chamber, said conveying means being characterised by relatively narrow upstanding edges which are spaced so as to support each can end at two narrow regions of its curled edge.

It will be appreciated that contact with the curled edge of a can end is relatively non-critical since it is turned in when the end is applied to a can body. Therefore the contact between the conveyor and the end is in a region which will not be exposed in the final product.

The supporting of the can ends in the above described manner also ensures that the countersink portion of the end is not in contact with the conveyor so that any protective lacquer coating applied to the underside of the can end will remain undamaged. Furthermore, the sealant applied to the downwardly directed surface of the end is similarly untouched by the conveyor during its passage through the oven.

The conveyor is preferably constructed from a plurality of interconnected slat-like elements having upturned edges so that each link is in the form of a shallow U-profile. As described above the spacing between the upturned edges is selected so that the edges engage only narrow portions of the curled edge of each can end. This arrangement ensures that any protective coatings on critical portions of the end which are exposed to the contents of the can in use are less likely to be damaged during the heating and cooling processes.

Preferably said generally elongate heating chamber closely surrounds the conveyor to reduce the surface area of the chamber exposed to said heat source.

The walls of the chamber and the upper surface of the conveyor are preferably reflective to ensure that the heat source is concentrated on the can ends.

The heat source is preferably a radiant heat source incorporating a reflector which concentrates the heat energy in a generally narrow band which corresponds generally in width to the width of the region of the can end to which the sealant and/or repair lacquer has been applied. The heat source preferably has a parabolic reflector and is an infra-red heat source.

The oven preferably has a cooling chamber following the heating chamber and of similar dimensions to the heating chamber, said cooling chamber including means for directing a stream of cool gas onto a central region of the can end as it is conveyed through the oven.

In a preferred embodiment of the invention, any combination of the first and second aspects of the invention and the described preferments may be incorporated into the oven. Preferably all of the features described above are incorporated in the oven.

BRIEF DESCRIPTION OF THE DRAWINGS

One presently preferred embodiment of the invention will now be described with reference to the accompanying drawings in which.

DESCRIPTION OF PREFERRED EMBODIMENT

Figure 1:
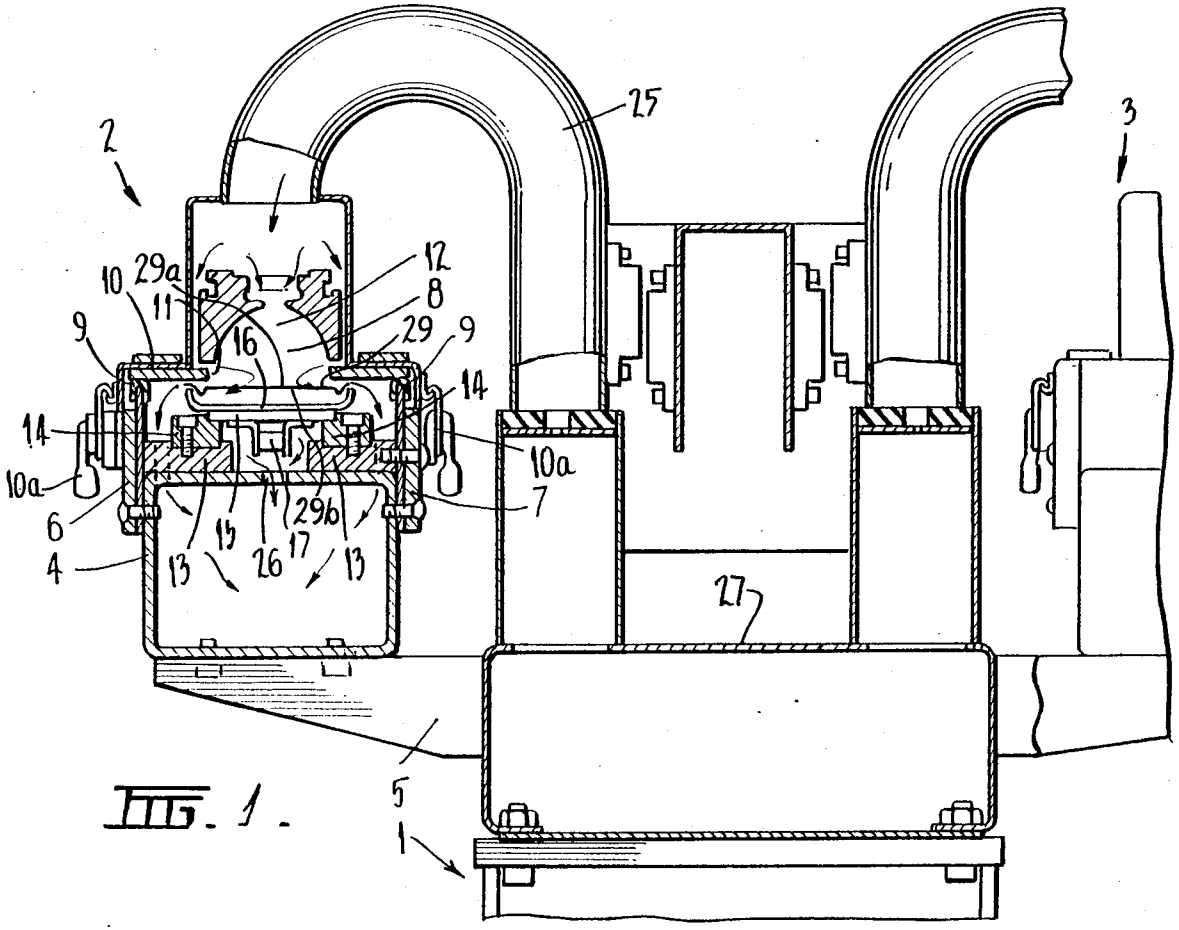
FIG. 1 is a sectional end elevation of the oven embodying the invention through part of the heating zone of the oven.

Referring firstly to FIG. 1 of the drawings, the apparatus will be seen to comprise a central supporting stand 1 supporting two identical oven assemblies 2 only one of which is shown and only one of which will be described in further detail. The oven assemblies 2 are provided to accept can ends from the respective lanes of a two lane end conversion press of known construction.

The oven assembly 2 comprises a base tube 4 mounted on supporting arms 5 extending from the central stand 1 and to the upper portions of the sides of which parallel side elements 6, 7 are secured as shown to define an elongate oven zone 8 of rectangular cross-section. The upper edges of the side walls 6, 7 have seals 9 fitted thereto and the top of the oven zone 8 is closed by means of a closure lid 10 which is held in position on the side walls 6, 7 by releasable clamping mechanisms 10*a* as shown.

At a plurality of positions along an initial portion of the length of the oven, the cover 10 is formed with an opening 11 over which infra-red radiation lamps 12 are mounted to direct infra-red radiant heat into the heating zone 8. In the present embodiment, four Phillips parabolic reflector infra-red heaters having a type IGR-P790 body and 13230X lamps are arranged substantially end to end over the opening 11. The number of lamps selected in the present case was to ensure that the oven performed adequately in a cold climate and it may be possible to reduce the number of lamps in a warmer climate.

The upper surface of the support tube 4 has spaced pairs of mounting blocks 13 secured thereto as shown. Stepped wear strips 14 are mounted on the support blocks 13 as shown and are engaged by wear pieces 15 secured to conveyor slats 16 and to a roller chain 17 driven by suitable sprockets (not shown) to move the conveyor through the oven.

Figures 2, 3:
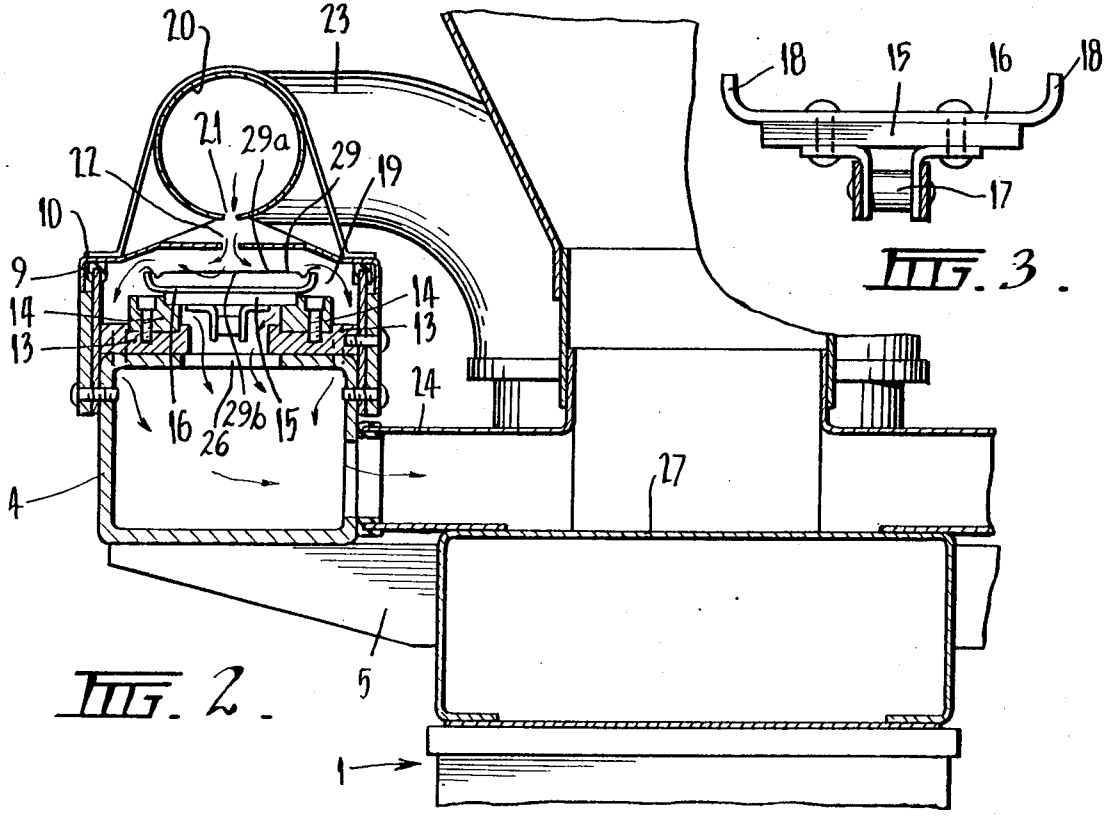
FIG. 2 is a similar sectional end elevation through part of the cooling region of the oven.
FIG. 3 shows details of the slats of the conveyor assembly.

As is shown in more detail in FIG. 3 of the drawings, each slat 16 is of shallow U configuration providing narrow upstanding edges 18 by means of which can ends are supported by means of engagement with short and narrow areas of their curled edges. The slats 16 are spaced apart by a short distance along the length of the conveyor to give the conveyor the necessary flexibility to pass around its endless path.

Referring now to FIG. 2 of the drawings, a second portion of the oven following the heating zone 8 provides a cooling zone 19. In this zone 19 the cover 10 is modified to support an elongate tube 20 having slots 21 in its lowermost portion overlying wider slots 22 in the cover 10. Cooling air is delivered to the tube 20 through a conduit 23 and passes through the slots 21 and 22 onto the upper surface of the can ends (not shown) supported by the conveyor. The cooling air impinges onto the top surface of the can ends and thence downwardly through apertures in the support tube 4 at either side of the conveyor and also between the can ends and through the spaces between the slat and wear pieces and through holes 26 in the top of the support tube 4. An air evacuation duct 24 is connected to the support tube 4 to draw the cooling air therefrom. Following the cooling zone, the conveyor delivers the can ends to a collection chute or the like (not shown).

In the case of the heating zone, each heating lamp 12 has an air duct 25 located centrally thereof to deliver air for cooling each lamp 12 and for purging undesirable gases and volatiles from the heating zone 8. It will be noted from FIG. 1 that the air circulates around the back of the lamp through apertures in the lamp body into a cavity behind the lamp reflector and also circulates down the sides of the lamp through holes (not shown) in the portions of the lid 10 supporting the lamps 12 across the top of the can end (not shown) down the sides of the conveyor between the supports 13 and through openings in the top of the support tube 4 near the sides thereof and also between the can ends and between the slats and wear pieces under the conveyor and through central openings 26 in the top of the support tube 4. A suitable fan or fans (not shown) drive the air through the inlet tubes 25 and draw the air through the outlet duct 24 via a central duct 27 which services both ovens 2.

Each heater 12 is arranged to direct a relatively coherent narrow beam of radiant energy onto the upwardly directed surface of each can end supported by the conveyor. For this reason, the orientation of the can ends as they enter the oven should be arranged such that the closure tabs, for example, in the form shown in any one of the previously described Australian patents, is aligned with the direction of travel of the conveyor so that the sealant applied to the downwardly directed side of the can end and any repair lacquer applied to the upwardly directed side of the can end in the region of the tabs is appropriately heated. Where it is necessary to apply repair lacquer, a suitable spray nozzle may be arranged near the entry to the oven to spray a band of repair lacquer across the panel portion of each can end including the region in which the tabs are formed.

Since the can ends are supported by the conveyor with the sealant applied thereto directed downwardly, the radiant energy applied to the upwardly directed surface of the can end will heat the can end so that the sealant is heated by the metal surface outwardly rather than from the outer surface of the sealant inwardly. This arrangement is advantageous for several reasons:

(1) the heat is applied to the less critical side of the end, (2) any lacquer applied to the end is also heated before the sealant is heated to promote adhesion between the sealant, usually a pvc plastisol, and the lacquer, (3) the heating of the sealant is primarily by conduction through the metal which is more positive than say by the use of hot gases within the heating zone, and (4) direct radiant energy heating of the can end is a more efficient conversion of the heat energy for the required purpose than in the case of hot gas heating.

It will be noted from FIG. 1 of the drawings that the surfaces defining the heating zone 8 are closely adjacent the conveyor such that the surface area of the heating zone is as small as possible. Furthermore, the slat 16 and the inner surfaces of the side walls and top are preferably highly reflective to ensure that the radiant heat energy is concentrated on the can ends carried by the conveyor. Furthermore, as mentioned above, the supporting of the can ends by the upstanding edges 18 of the slats 16 not only ensures that the ends are supported at the less critical curl of the ends but also that the metal to metal contact between the ends and the conveyor is confined to the non-critical curl area of the end.

By virtue of the features described in greater detail above, the cross-sectional dimensions of the oven are substantially smaller than the cross-sectional dimensions of the known ovens used in the can making industry and the processing time is substantially reduced from a time of the order of 40 to 60 seconds to a time of the order of 5 to 10 seconds. With the oven of the present invention, the can ends are arranged closely adjacent to each other in single file rather than being spread somewhat randomly across a much wider wire mesh conveyor as used in the prior art ovens. Thus the efficiency of the processing operation is markedly improved and the heat losses from the oven are substantially reduced.

We claim:

1. A method of heating can ends in an oven, said can ends having an upper surface and a lower surface, said method comprising:

at least partially coating said lower surface of said can ends with a heat-curable coating;

providing an oven comprising an elongate heating chamber, a source of heat, disposed within said heating chamber, and conveying means, disposed beneath said source of heat, for conveying said can ends through said heating chamber, said conveying means including support means, engageable of said can ends, for supporting said can ends without contacting said heat-curable coating;

supporting said can ends on said support means with said lower surface directed downwardly;

conveying said so-supported can ends through said elongatge heating chamber on said conveying means beneath said source of heat;

applying heat from said source of heat to said upper surface of said can ends to heat said upper surface of said can ends;

conducting heat through said can ends from said heated upper surface to said lower surface to cure said heat-curable coating on said lower surface, whereby said heat-curable coating is cured principally by heat absorbed by said can ends.

2. The method of heating can ends according to claim 1, wherein said source of heat is a radiant heat source.

3. The method of heating can ends according to claim 1, wherein said radiant heat source is an infra-red heat source.

* * * * *